US005603649A

United States Patent [19]

Zimmerman

[11] Patent Number: 5,603,649

[45] Date of Patent: Feb. 18, 1997

[54] STRUCTURE AND METHOD OF MAKING FIELD EMISSION DISPLAYS

[75] Inventor: Steven M. Zimmerman, Durham, N.C.

[73] Assignee: International Business Machines, Corporation, Armonk, N.Y.

[21] Appl. No.: 448,956

[22] Filed: May 24, 1995

Related U.S. Application Data

[62] Division of Ser. No. 28,047, Mar. 8, 1993.

[51] Int. Cl.[6] ..... H01J 1/30; H01J 9/18; H01J 9/227

[52] U.S. Cl. ..... 445/24; 445/50

[58] Field of Search ..... 445/24, 50, 51; 216/11

[56] References Cited

U.S. PATENT DOCUMENTS

| | | | |
|---|---|---|---|
| 4,626,739 | 12/1986 | Shmulovich | 313/469 |
| 5,141,459 | 8/1992 | Zimmerman | 445/24 |
| 5,203,731 | 4/1993 | Zimmerman | 445/51 |
| 5,463,269 | 10/1995 | Zimmerman | 313/309 |
| 5,529,524 | 6/1996 | Jones | 445/24 |

FOREIGN PATENT DOCUMENTS

| | | | |
|---|---|---|---|
| 5-159718 | 6/1993 | Japan | 313/461 |

*Primary Examiner*—P. Austin Bradley

*Assistant Examiner*—Jeffrey T. Knapp

*Attorney, Agent, or Firm*—Whithan, Curtis, Whitham & McGinn

[57] ABSTRACT

A FED device is manufactured as a self-aligned structure that allows the FED device to be fabricated in any desired size. The FED device has a transparent face plate with a thin film phosphor layer deposited thereon. A conductive anode layer is deposited on the phosphor layer. This anode layer has apertures allowing electron impingement on the phosphor layer. One or more insulator layers serving as a spacer are deposited on the anode layer. A conductive extraction grid layer is deposited upon the insulator layers. The conductive extraction grid layer, the spacer insulator layers and said anode layer are then etched to form an array of vacuum space holes extending to said phosphor layer. A conformal layer of a material that can be selectively etched is then deposited over the structure. The conformal layer fills and forms cusps over the vacuum space holes. An electron emitter layer is deposited over the conformal layer and is molded in the form of an array of sharply pointed structures separated from the extraction grid. An emitter insulator layer is deposited on the emitter layer and in contact with it. The emitter layer and said emitter insulator are etched to form access holes communicating with the vacuum space holes. The conformal layer is then selectively etched through these access holes to again open the vacuum space holes between the cathode emitter and the phosphor layer. An envelope is sealed to the face plate enclosing the emitter layer, extraction grid layer and said phosphor layer in a vacuum.

4 Claims, 11 Drawing Sheets

STRUCTURE AND METHOD OF MAKING FIELD EMISSION DISPLAYS

CROSS REFERENCE TO RELATED APPLICATION

This application is a divisional of application Ser. No. 08/028,047 filed Mar. 8, 1993. The subject matter of this application is related to that of my patent application Ser. No. 07/847,444 filed Mar. 6, 1992, for Process and Structure of an Integrated Vacuum Microelectronic Device, now U.S. Pat. No. 5,463,269, which is a continuation of application Ser. No. 07/555,214 filed Jul. 18, 1990, now abandoned, and assigned to the assignee of this application. The disclosure of application Ser. No. 07/847,444 is incorporated herein by reference.

BACKGROUND OF THE INVENTION

1. Field of the Invention

The present invention generally relates to field emission display (FED) devices and, more particularly, to a new monolithic FED device and method of fabricating it.

2. Description of the Prior Art

Flat panel displays are of great interest for applications in laptop and palmtop computers, avionic and automobile consoles, information displays, high definition television (HDTV), to name but a few applications. Currently, much activity is focused on liquid crystal active matrix displays (LCDs) for use in many of these applications. LCDs have many shortcomings. They have low efficiencies, a restricted viewing angle, slow response time, and back lighting makes them thicker and heavier than desired for many applications. Field emission displays (FEDs) can solve all of these problems by bringing cathode rate tube (CRT) advantages into a flat panel configuration while eliminating the traditional CRT magnetic field and X-ray emission health concerns.

FEDs are a particular class of vacuum microelectronic devices (VMDs) and share the basic structure of those devices including a field emission cathode tip within an extraction electrode structure and an anode within a vacuum space. FEDs add to this basic structure a phosphor surface opposite the cathode tip and may include additional electrodes to control the electron current. A characteristic of FEDs common to VMDs in general is the requirement for precise alignment of the microstructure. This, in turn, has meant in the past complex and expensive manufacturing, making the FEDs uncompetitive with LCDs or the older CRT technologies. Several attempts have been made to develop a simpler and less cosily technique for manufacturing VMDs and FEDs in particular. One example is described by C. A. Spindt in "A Thin-Film Field-Emission Cathode", *J. Appl. Phys.*, vol. 39, no. 7, pp. 3504–3505 (1968), described in more detail hereinafter. Another approach is described in U.S. Pat. No. 3,665,241 to Spindt et al. uses orientation dependent etching of single crystal materials such as silicon. Single crystal materials are, however, both expensive and limited in size. Fukase et at. in U.S. Pat. No. 3,998,678 describe another approach which uses isotropic etches to form the structures. In the Fukase et al. method, an emitter material is masked using islands of a lithographically formed and etch resistant material. The emitter material is then etched resulting in an etch profile which converges under the center of the mask in the form of a sharp tip. Smith et al. in U.S. Pat. No. 3,970,887 describe an oxidation process to form VMDs, and Gray et al. in U.S. Pat. No. 4,307,507 describe a process wherein a pit which is the inverse of the desired shape is etched in an expendable material and then used as a mold for the emitter material.

All of the techniques known in the art have limitations which, when applied to the manufacture of FEDs in particular, do not permit the manufacture of such devices with sufficient economies or precision to be competitive with current display technologies.

SUMMARY OF THE INVENTION

It is therefore an object of the present invention to provide a monolithic FED structure which can be simply and inexpensively manufactured.

In my prior U.S. Pat. No. 5,141,459, I describe structures and processes for fabricated field emission cathodes. In accordance with the processes disclosed therein, the cathode tip is accurately aligned inside an extraction/control electrode structure in a vacuum environment. The field emission cathode structure is made by first providing a hole in a substrate, then depositing at least a first material and filling at least a portion of the hole sufficiently to form a cusp, followed by depositing at least one layer of a material which is capable of emitting electrons under the influence of an electrical field and filling at least a portion of the tip of the cusp. The first material is then removed underneath the cusp to expose at least a portion of the tip of the electron-emitting material to thereby form the field emission cathode structure.

The invention disclosed in my aforementioned application Ser. No. 07/847,444 improves on the technology by providing a novel two step etch process to eliminate excessive undercut in the removal of the material under the emitter tip. Also disclosed are more complex structures, including tetrodes and pentodes, as well as passive devices.

According to the present invention, there is provided a FED device of any desired size having a transparent face plate with a thin film phosphor layer deposited thereon. A conductive anode layer is deposited on the phosphor layer. This anode layer has apertures allowing electron impingement on the phosphor layer. One or more insulator layers serving as a spacer are deposited on the anode layer. A conductive extraction grid layer is deposited upon the insulator layers. The conductive extraction grid layer and the spacer insulator layer are then etched to form an array of vacuum space holes extending to said phosphor layer. The anode layer may be etched at this time or, depending on the sensitivity of the phosphor layer to subsequent processing, may be left to protect the phosphor layer and removed as a final step. The anode layer may also be left intact in the completed device if the material, structure and/or height of this vacuum space hole allow the use of sufficiently high anode potentials to allow the electrons to penetrate the anode layer. A conformal layer of an insulator material that can be selectively etched is then deposited over the structure. The conformal layer fills and forms cusps in the vacuum space holes. An electron emitter layer is deposited over the conformal layer. Due to the cusps formed over the vacuum space holes, the emitter layer is molded in the form of an array of sharply pointed structures separated and insulated from the extraction grid. An emitter insulator layer is deposited on the emitter layer and in contact with it. The emitter layer and said emitter insulator are etched to form one or more access holes communicating with the conformal layer filing the vacuum space holes. The conformal layer is then selectively etched through these access holes to again open the vacuum space holes between the cathode emitter and the phosphor layer. The anode layer, if not previously etched, may now be etched, if required, to expose the phosphor. A particular feature of this structure is that the array of sharply pointed structures are self-aligned with said array of vacuum space holes and the integrated spacer (separating the anode/phosphor from the cathode). A getter material may be laid over this finished structure before an envelope is sealed to the back of the face plate enclosing the getter, emitter layer, extraction grid layer, and the phosphor layer in a vacuum.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
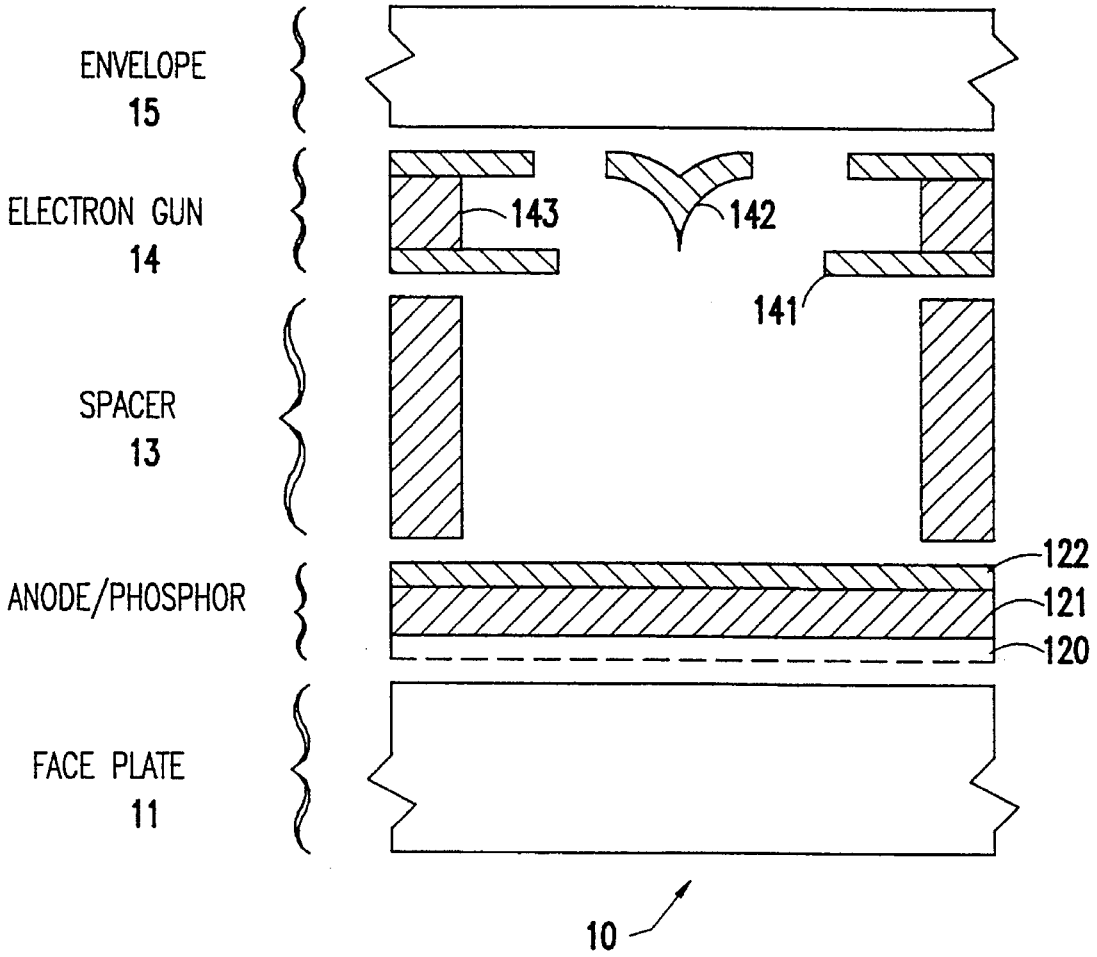
FIG. 1 is a cross-sectional view illustrating the basic components in a FED device.

Referring now to the drawings, and more particularly to FIG. 1, there is shown a conceptual drawing identifying typical structural display elements, how they are represented, and defining some of the terms used. Note that in some cases, two or more of these functions may be combined into a single element as, for example, in a CRT where the envelope not only encloses the vacuum space but also provides the spacer function by supporting the electron gun assembly.

In FIG. 1, the FED device 10 comprises a face plate 11, typically a transparent material such as glass. A transparent anode 120 (which is optional), a phosphor 121, and a gun-side anode 122 (typically a reflective metal), in that order, are immediately adjacent to the face plate 11. These are separated by a spacer 13 from the electron gun 14. The electron gun is composed of an extraction grid 141 and an emitter 142 separated by an insulator 143. The structure is sealed with an envelope 15 which may be welded to the glass face plate 11 to form an evacuated space within which electrons may be emitted from the emitter 142 and impinge on the phosphor 121 to produce cathode luminescence observable by a viewer through the face plate 11.

Figure 2:
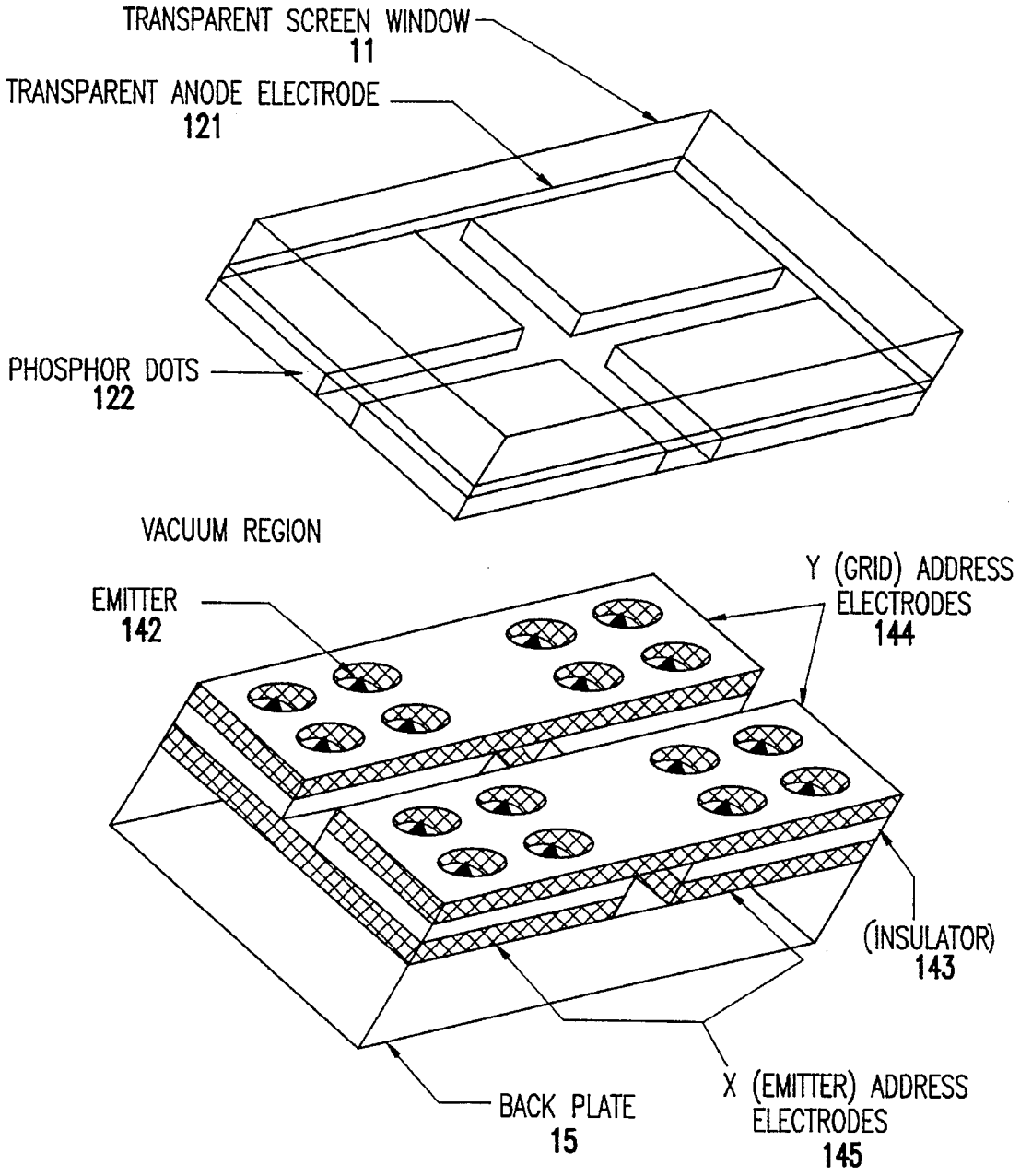
FIG.2 PRIOR ART
FIG. 2 is an exploded pictorial view further illustrating the basic structure of a typical FED device.
Figure 3:
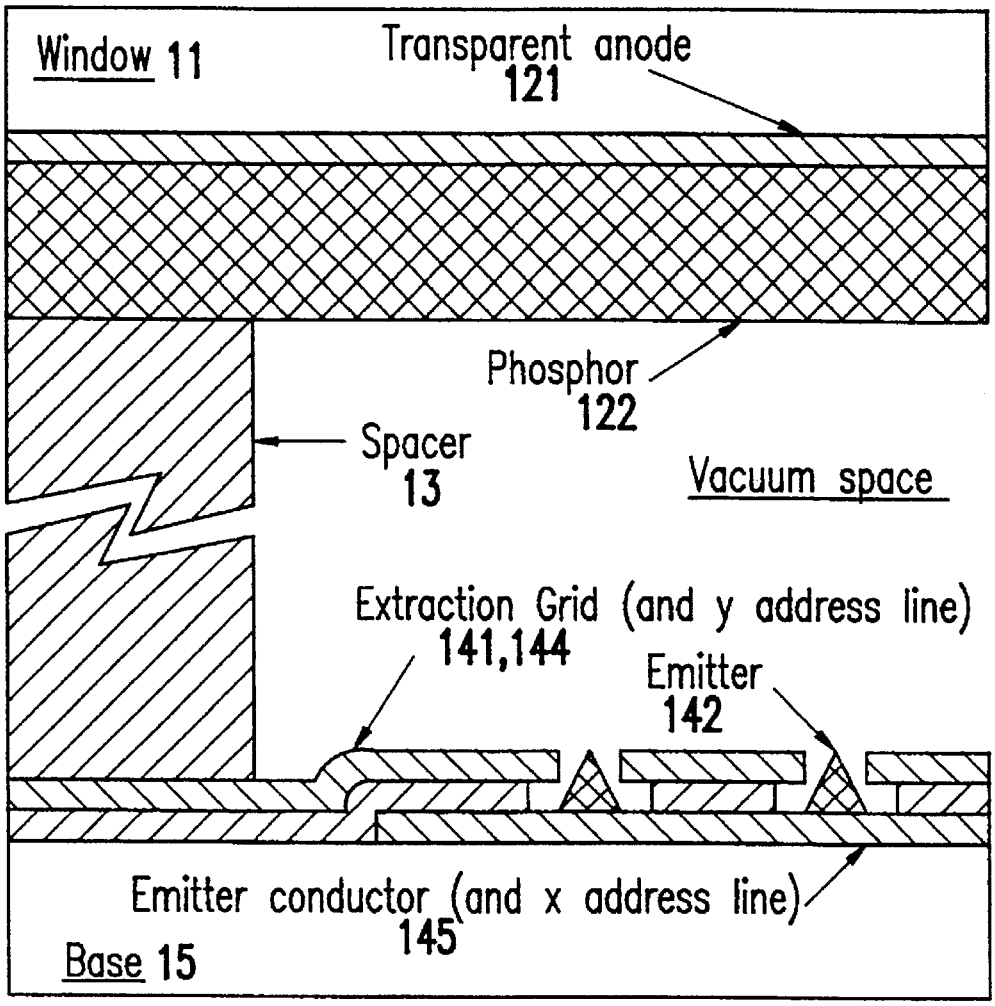
FIG.3 PRIOR ART
FIG. 3 is a cross-sectional view showing an existing FED structure.

While FED prototypes have been demonstrated by others, they have several limitations and/or complexities that need to be overcome in order for them to be accepted in widespread commercial use. FIGS. 2 and 3 are generic representations of prior art FED structures. A specific example of the type of display structure may be found with reference to U.S. Pat. No. 4,857,799 to Spindt et at. Referring first to FIG. 2, there is illustrated a typical FED prototype device. In this illustration, the spacer structure is not shown to simplify the drawing. The structure illustrated is an array of emitters and phosphor dots arranged in a matrix, there being four emitters for each phosphor dot in the example illustrated. Many more are used in practice, ranging from hundreds to thousands per phosphor dot. For purposes of illustration, a group of four emitters are addressed by Y (grid) electrodes 144, which are integral with the extraction grid 141, and X (emitter) electrodes 145 connected to the emitters 142.

FIG. 3 shows a simplified cross-section of the type of display shown in FIG. 2. The cathode, consisting of sharp emitter tips 142 on a conductive layer, an insulator layer 143, and a grid or extraction electrode layer 141 with circular openings (typically 1 to 2 μm diameter) located annularly around each tip, is built on a flat back plate 15. There are generally many hundreds of tips per pixel. Individual pixels are defined by featuring these-two conductor layers into broad orthogonal phosphor dot-width strips (as shown in FIG. 2) that form the phosphor dot addressing matrix. A pixel (picture element), which defines the resolution of the display, typically consists of one phosphor dot in a monochrome display and three independently addressable areas of three different phosphors (i.e., red, green and blue) in color displays. The transparent front plate 11 is covered by a transparent anode conductor 120 and a powder phosphor 121 (three regions of three different phosphors being used for color). A spacer 13, critically aligned to the spaces between pixels, is fabricated on the emitter structure. The number of spacers depends on the rigidity of the window 11 and back plate 15 and generally does not exceed one support per pixel and may be considerably sparser. The two plates 11 and 15 are critically aligned to each other (in color applications), assembled, edge sealed, and evacuated to complete the display screen assembly.

Operation simply consists of placing a potential across a tip line 145 (x address) and a grid line 144 (y address), the tips 142 being negative relative to the grids 141, and placing a high positive potential on the anode 122. The extremely high field created at the tip 142 by the charge on the grid 141 allows electrons to tunnel from the tip in to the vacuum space. The high anode potential accelerates these electrons toward the anode 122 where they bombard the phosphor 121 and excite the emission of visible light which is viewed through the transparent anode 122 and clear screen 11. Altering the grid potential alters the tip current and can provide intensity control. Intensity can also be controlled by varying the fraction of a time period the grid is turned on.

The present invention improves on the methods used to fabricate the gun (tip 142, grid 141 and insulator 143) and spacer 13. A brief description of the currently used methods are described to contrast with that of the invention.

Figure 4A:
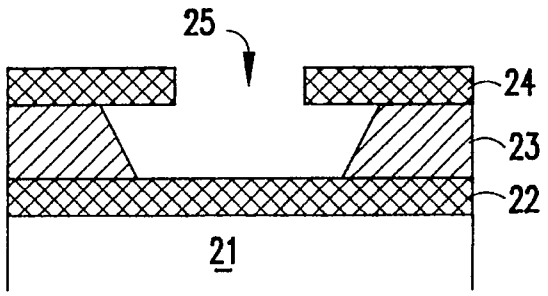
FIG. 4A PRIOR ART
FIGS. 4A to 4C are cross-sectional views showing a known process for cathode formation.
Figure 4B:
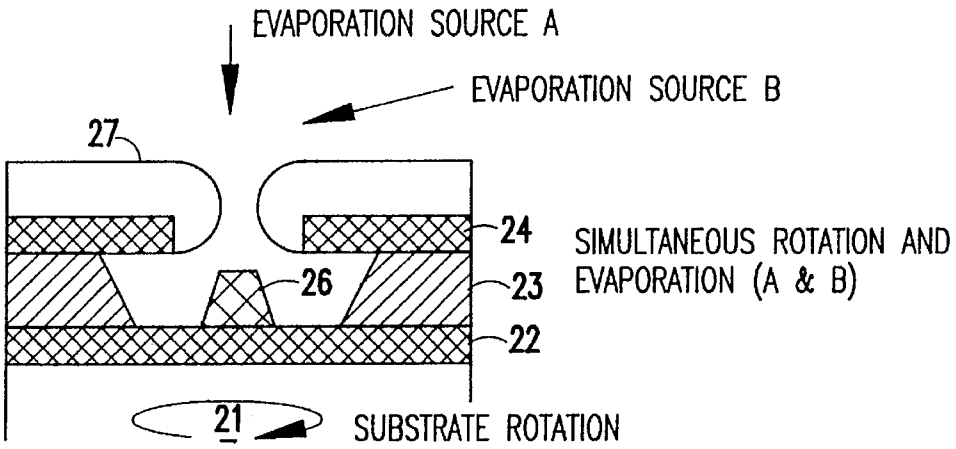
FIG. 4B PRIOR ART
Figure 4C:
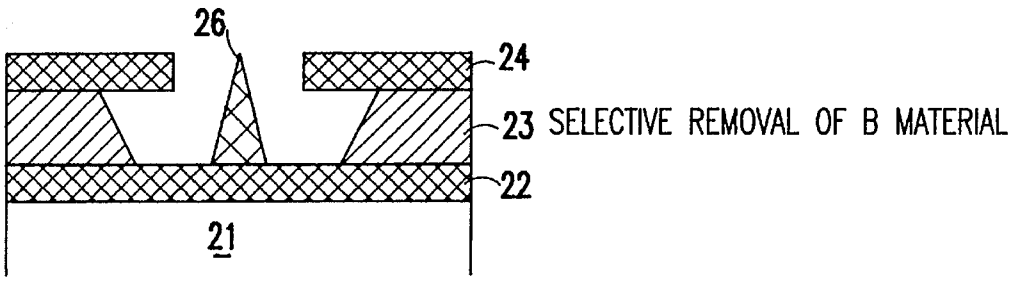
FIG. 4C PRIOR ART

Current prototypes use the Spindt method of emitter fabrication described in "A Thin-Film Field-Emission Cathode", *J. Appl. Phys.*, supra, and illustrated in FIGS. 4A to 4C. As shown in FIG. 4A, a substrate 21 covered with alternating layers of a conductor 22, an insulator 23, and a conductor 24 is featured with small holes 25 (1 to 2 μm in diameter) penetrating the conductor and insulator layers 24 and 23, respectively. Then while this substrate 21 is rotated, two separate materials are evaporated onto it simultaneously from two different sources, as shown in FIG. 4B. One material from a vertical source (source A) deposits on the surface and into the hole forming a tip 26, while the second material, from a low angle source (source B), deposits on the surface and the top sidewall of the hole at 27. As the side wall deposit 27 builds up, the vertical material enters the hole through a decreasing diameter which produces a cone shaped deposit 26 in the hole (the tip). Subsequently, in FIG. 4C, the expendable side wall material is selectively removed leaving the tip 26 in the grid opening. This process is both complex and provides no simple method to produce an integrated planar anode structure over this gun. Additionally, since it is a liftoff type of process, evaporation solid angles must be restricted leading to unrealistically large evaporator chambers for the production of larger area displays.

The spacers in the current prototypes use photosensitive polyimide or glass spheres adhered to the surface. The solvents, binders, and other chemicals may present contamination problems in the vacuum that affect device lifetimes. In addition, the tendency of polyimide to hold water and the shapes of the glass spheres may limit the high voltage isolation and leakage properties of these spacers.

A new method of tip and electrode fabrication, which is explained in detail in my earlier U.S. Pat. No. 5,141,459 and the cross-referenced patent application Ser. No. 07/847,444, provides a method for producing a completely new monolithic FED structure shown in FIG. 5. A novel inverted structure is used, forming the tip last rather than first, which is self-aligned, considerably simpler, and uses processes that are applicable over large areas. In this structure, the phosphor 31 is applied to a face plate 32 and the anode 33, with apertures, is applied over the phosphor. A self-aligned insulator 34 serves the function of the spacer 13 shown in FIG. 1. The grid 35 is spaced from the emitter layer 36 by another insulator 37, and the emitter 38 is formed in the emitter layer 36, and all of these are formed in a self-aligned process described in more detail below.

The following sections describe the display fabrication process, reasons for the operation, possible variations, and the advantages and/or disadvantages it represents for the new structure. A typical process sequence is used to illustrate the fabrication of the generic monolithic display example.

Since many of the processing methods are repeated using the same basic methods, they will be named and defined once. These process terms will be used in the following process discussions and will be understood to refer to the more detailed descriptions given here.

The terms "lithographically defined" or "patterned" refer to a process sequence including the following process steps. First, a masking layer that is sensitive in a positive or negative sense to some form of actinic radiation as for example light, electron beams and/or X-rays, is deposited on the surface of interest. Second, this layer is exposed with a pattern to the appropriate actinic radiation and developed to selectively remove the masking layer and expose the underlying surface in the patterns required. Third, the exposed surface is etched to remove all or part of the underlying material, as required. Fourth, the remaining areas of the masking layer are removed.

The terms "electrode layer", "conductor" or "conductive layer" refer to any of a wide variety of materials which are electrical conductors. Typical examples include various metals commonly used in electronic devices, alloys or solid solutions containing two or more metals, doped and undoped semiconductors and those commonly known as III–V compounds, and non-semiconductive compounds such as various nitrides, borides, cubides (as for example $LAB_6$), and some oxides (as for example oxides of Sn, Ag and InSn).

The terms "insulator layer" or "insulator" refer to a wide variety of materials that are electrical insulators, especially glasses and ceramics. Typical examples include elements such as carbon (selected diamond forms, crystalline or amorphous), single crystal compounds such as sapphire, glasses and polycrystaline or amorphous compounds such as some oxides as of Si, Al, Mg, and Ce, some fluorides as of Ca and Mg, some carbides and nitrides as of Si, and ceramics such as alumina or glass ceramic.

The terms "emitter layer" or "emitter material" refer to any material capable of emitting electrons under the influence of an electric field. Typical examples include any of the conductors listed as examples above and borides of the rare earth elements, solid solutions consisting of 1) a boride of a rare earth or an alkaline earth (such as Ca, Sr or Ba), and 2) a boride of a transition metal (such as Hf or Zr).

The term "deposited" refers to any method of layer formations that is suitable to the material as is generally practiced through the industry.

The phosphor deposition step in the practice of the present invention represents a radical departure from the techniques used in the other prototypes and requires an introduction to some of the basic issues in display phosphor technology.

Figure 6A:
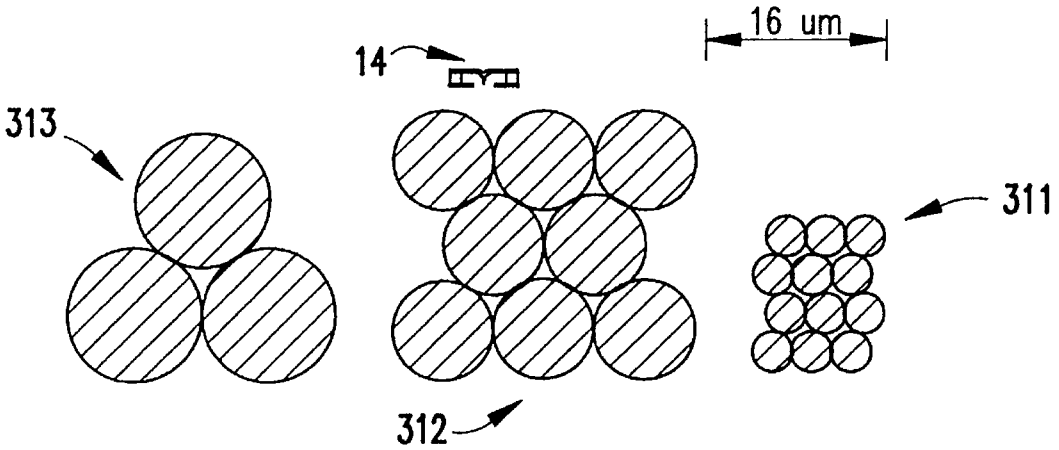
FIG. 6A shows the relative sizes of powder phosphor screens as compared with the electron gun structure shown in FIG. 1.

Typical powder phosphors like those used in the existing prototypes are large particles 311,312 or 313 (typically 3 to 12 μm in diameter), as shown in FIG. 6A, deposited in several layers (typically two to four layers). They are deposited by a variety of means which result in a low density, open, and delicate surface. The surface is grossly irregular in terms of the scale of the emitter tip 14, is a poor conductor of heat which limits its useful energy dissipation, and has limited resolution due to both particle size and scattering. Building an electron gun structure 14, such as shown in FIG. 1, directly on such a surface would be impractical, and the phosphor's large scale irregularities necessitates a substantial distance between it and the electron gun assembly to assure uniformity of operation.

Figure 6B:
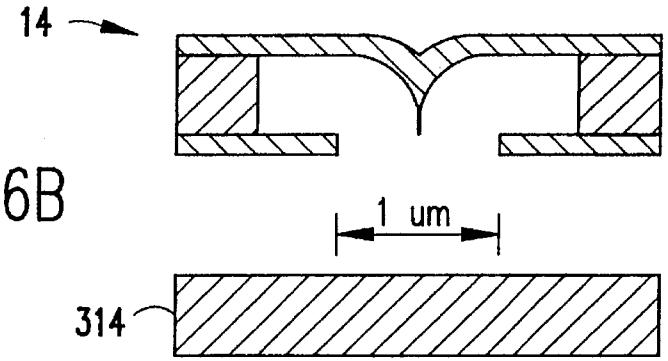
FIG. 6B shows the relative size of a thin film phosphor screen as compared with the electron gun structure shown in FIG. 1.

Thin film phosphors 314, such as illustrated in FIG. 6B, can overcome many of these limitations. They are typically made of the same materials but deposited by thin film techniques. The surfaces produced are smooth, robust even to the extent of being polishable, and are much better heat conductors which allow them to operate at higher currents and brightness. When properly formed, they have equivalent overall efficiencies and, according to some sources, may have longer lifetimes than their powder counterparts. They are generally transparent as deposited (very small grained), can be multilayered (useful in color applications), and exhibit exceptional resolution and contrast. FIGS. 6A and 6B shows a scaled comparison between electron guns 14 and phosphors that illustrate some of the characteristics described.

Figure 7A:
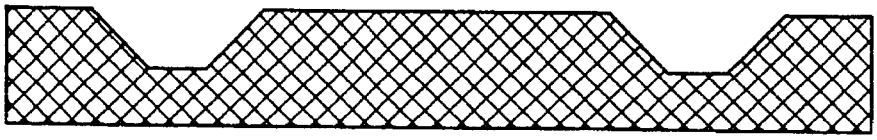
FIG.7A PRIOR ART
FIGS. 7A to 7C respectively show reticulate, anneal and feature methods of overcoming the effects of light trapping in thin film phosphor screens.
Figure 7B:
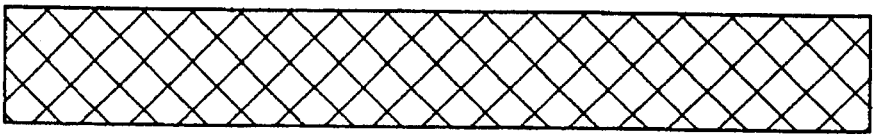
FIG.7B PRIOR ART
Figure 7C:
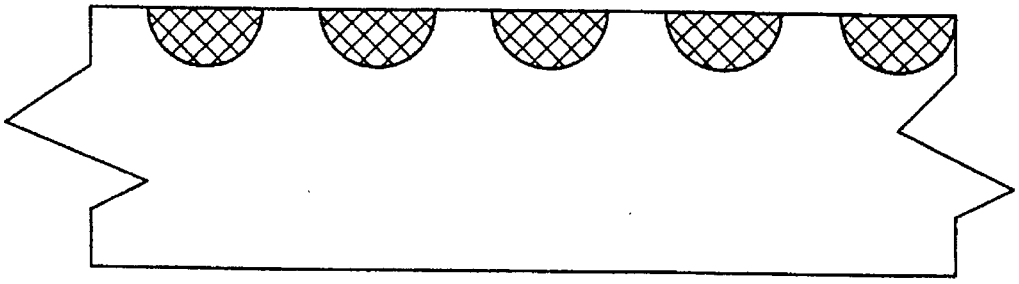
Figure 8A:
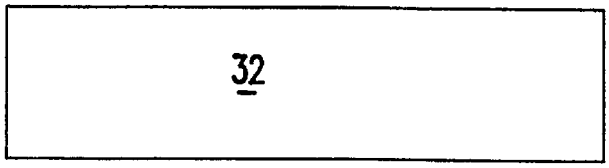
FIGS. 8A to 8E are cross-sectional views showing the process of fabricating a phosphor screen using featuring to control light trapping according to a preferred embodiment of the invention.
Figure 8B:
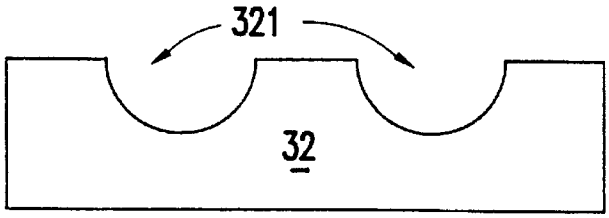
Figure 8C:
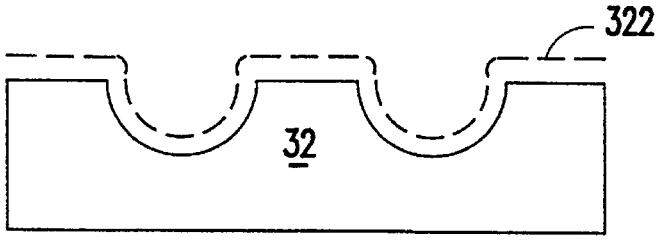
Figure 8D:
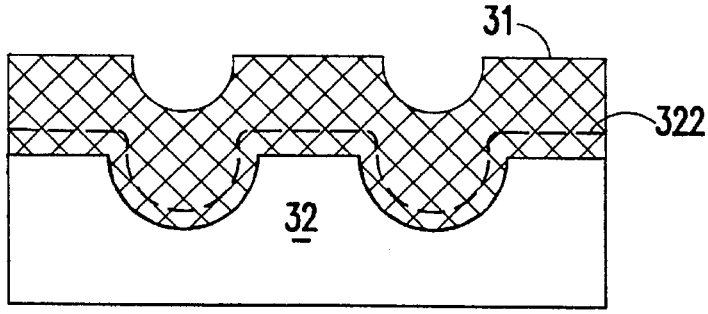
Figure 8E:
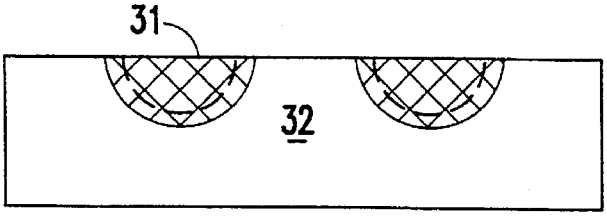

While they are also more expensive to produce, the key drawback of thin film phosphors is light trapping. Light generated inside the thin transparent film is totally internally reflected if it hits the film boundary at greater than the critical angle of the material. Since this light does not get to the viewer, there is an apparent reduced efficiency of emission. There are, however, several methods of minimizing this problem which are illustrated in FIGS. 7A to 7C. The first two have been previously published, but the third is new and used in the preferred embodiment of the invention. The first method shown in FIG. 7A is reticulation. Reticulation uses a lithographic process to etch facets into the film which redirect trapped light toward the viewer. Scattering centers may also be introduced lithographically. This method is described by D. T. C. Huo et at. in "Reticulated Single Crystal Luminescent Screen", *Jour. Elec. Chem. Soc.: Solid-State Sci. & Tech.*, Vol. 133, No. 7, p. 1492.

The second method shown in FIG. 7B is annealing. Annealing the film allows the size of the crystals to grow and become large enough to scatter the trapped light. Angular dispersions nearly identical to powder screens can be produced by suitable annealing conditions. Annealing is the simplest technique since the processing requirements are minimal. This method is described by J. Shmulovich in "Advanced Tech.: Thin Film CRT Phosphors", *Info. Display*, March 1989.

The third and preferred method is shown in FIG. 7C. Featuring is a technique whereby the window surface is lithographically or otherwise processed to form pockets, typically rounded, across the surface. These pockets may be almost any size ranging from much smaller than an emitter to larger than a pixel. The surface is covered with the thin film phosphor and polished back to a flat surface. Light emitted at the flat phosphor surface (because of the low penetration depth of the electrons) finds a less than critical angle over a much greater solid angle due to the rounded boundary. Reflected light has a much greater chance of escaping because of the non-parallel surfaces. Featuring, unlike reticulation, also presents a planar surface to future processing steps. Obviously, any of these techniques may be combined to optimize performance.

The process of making the featured face plate shown in FIG. 7C is illustrated in FIGS. 8A to 8E. Beginning with the display face plate 32 shown in FIG. 8A, the face plate is featured to form the rounded pockets 321 shown in FIG. 8B. An optional transparent conductor 322 may be deposited at this time to produce the structure shown in FIG. 8C. Next, a thin film phosphor 31 is deposited in FIG. 8D, and this is polished flat to produce the structure shown in FIG. 8E with the thin film phosphor 31 filing each of the rounded feature pockets 321 but leaving a flat surface for succeeding processing steps.

Charge control is another critical phosphor concern. Electrons which do not cause the emission of light build up a charge on the phosphor layer. This charge can neutralize the accelerating field and/or deflect incoming electrons, thus curtailing light emission. In normal CRT configurations, the anode is a thin conductor layer (typically aluminum) deposited on the gun side of the phosphor. Being between the gun and phosphor, it shields the incoming electrons from any charge on the phosphor and also serves to drain off accumulated phosphor charge. The incoming electrons, however, must have sufficient energy to penetrate the anode in order to reach the phosphor, thus requiring high anode potentials. Since the small spacing in a flat FED device does not allow high anode potentials, some other means of charge control is needed. One method is to use conductive phosphors like ZnO. Unfortunately, there are very few conductive phosphors to choose from (a special problem for color applications) and, with the exception of ZnO, they are very inefficient. As far as is known, the existing prototype FEDs use conductive phosphors to control charge and have a transparent anode between the window and phosphor (so electrons do not have to penetrate it) to accelerate electrons and drain off charge which is conducted through the thick powder phosphor layer. Even so, the thickness and the discontinuous nature of the powder may limit the effectiveness of this approach. Thin film phosphors on the other hand provide solid conductive paths and much smaller distances which are superior in this configuration.

In the monolithic display structure according to the invention, a special situation exists in which the anode is between the phosphor and gun but does not block electrons because of the small self-aligned aperture in the anode at each emitter. With the anode in direct contract with the phosphor, both volume and surface conduction contribute to charge removal across very small distances. Additionally, the position of the perforated anode allows it to shield the electrons from the effects of phosphor charge. These effects are sufficient to allow the use of nonconductive phosphors, thus opening a wide selection of materials to choose from. ZnO may also be used in the composition of these phosphors to enhance conduction if needed. The required enhancement may be very small because of the extremely short conduction path length. Further, if desirable, an additional charge draining electrode in the form of a thin transparent conductor layer may be added between the phosphor and the window. This optional layer is illustrated using a broken line in FIGS. 8C to 8E. It may also have enhanced effectiveness due to volume conduction across the very thin (fractional micron) thin film phosphor layer.

Figure 5:
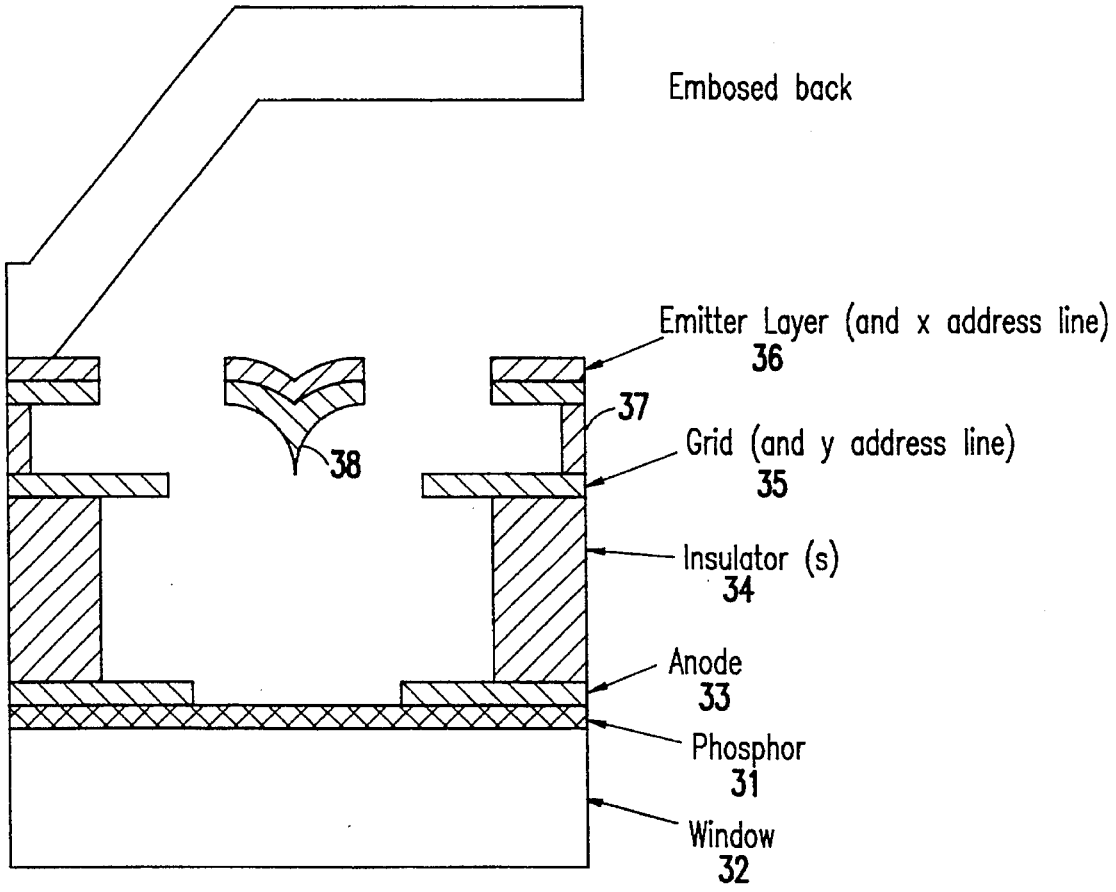
FIG. 5 is a cross-sectional view illustrating the basic structure of a monolithic FED device.

The perforated anode 31 shown in FIG. 5 offers another important benefit. Since light is emitted from the phosphor 33 in all directions, light emitted away from the viewer is lost (as in the existing prototypes) and reduces efficiency. In a conventional CRT, the aluminum anode serves to re-reflect that light back toward the viewer. Similarly, the perforated anode of the monolithic display can also reflect back a very high percentage of that light, minus that lost to the open area, thus improving efficiency over the existing prototypes. In practice, this benefit must be weighed against possible reductions in contrast due to the reflective anode.

Figure 9A:
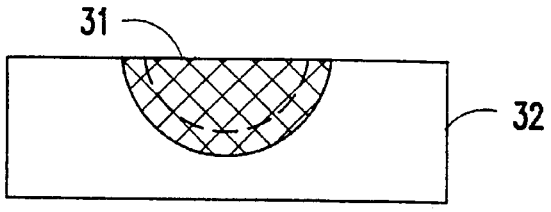
FIGS. 9A to 9D are cross-sectional views showing the process of electrode fabrication on the phosphor screen made according to the process shown in FIGS. 8A to BE.
Figure 9B:
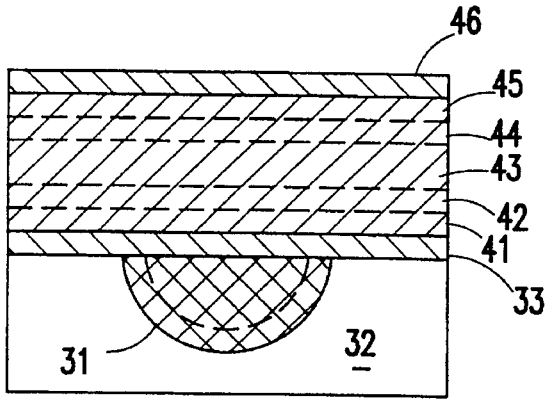

Beginning with the featured face plate 32 shown in FIG. 9A, the anode 33 used in the monolithic display is deposited directly on the phosphor layer 31 in FIG. 9B. Thereafter, alternating layers of an insulator 41, a conductor 42, an insulator 43, a conductor 44, an insulator 45, and a conductor 46 are deposited. The conductors 42 and 44 may be used for optional grids or omitted. The one or more insulating layers 41, 43 and 45 act as the spacer between the phosphor layer 31 and the gun structure. The optional conductors 42 and 44 can serve as screening grids that further shield incoming electrons from any charge build up on the phosphor, focusing grids, secondary suppression grids, reference planes, or the like. This ability to produce many electrodes by depositing conductor/insulator film pairs over largely planar surfaces is one of the advantages offered by this structure and process.

On the spacing insulator layer or layers, at least one grid conductor 46 is deposited. This conductor forms the grid called the extraction grid 35 (FIG. 5) which is primarily used to create the high field at the emitter tip, although it may also control intensity, select emitters, and serve other purposes through modulation of the extraction potential. One potential advantage of using secondary grids is to keep the higher extraction potential constant while modulating a smaller potential on the secondary grids for various control functions. Once again, since the entire display structure is still generally planar, uniformly depositing a number of these layers is very easy.

Figure 9C:
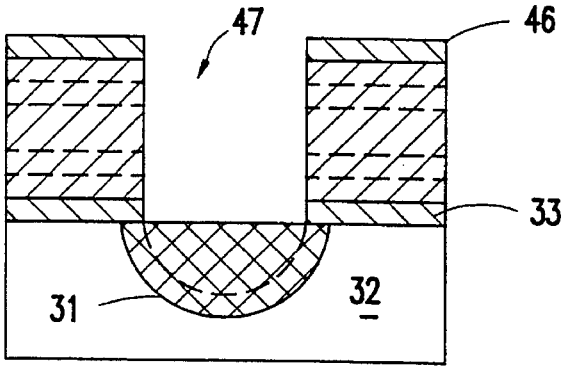

Apertures 47 in these layers are fabricated as part of the self-aligned emitter process. The apertures that will ultimately form the operating vacuum spaces across the display are now etched through the previously deposited layers down to the phosphor layer, as shown in FIG. 9C. This is typically done with reactive ion etching (RIE). The nominal size of the apertures is not critical but is typically 1 to 2 μm.

Figure 9D:
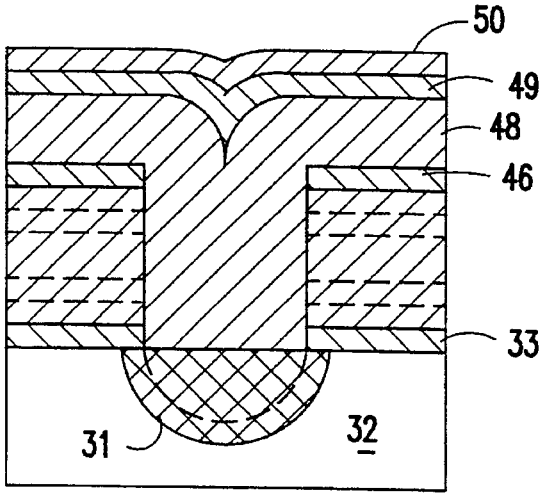

In FIG. 9D, a conformal deposition (e.g., with CVD) of a material 48 that can be selectively etched is deposited over the surface to a depth greater than half the width of the largest vacuum space hole. As long as this condition is met, the uniformity of emitter to extraction grid distance (a principle variable in current uniformity) is controlled exclusively by the uniformity in the thickness of this film. The sharply pointed cusp that forms over each hole is used as a mold to form a sharply pointed emitter tip when emitter material 49 is deposited over this surface. Finally, the emitter insulator layer 50 is deposited over the emitter material 49.

Another form of emitter materials made possible because the emitter fabrication method does not depend on single crystals of the material, substrates of the material., or thick layers of the material as does much of the prior art, is the composite or multilayered emitter. An example of a multilayer emitter include a work function enhancement layer, a robust emitter layer, a high performance electrically and thermally conductive layer, and a physically strengthening and/or stiffening layer. This multilayered composite may contain both emitter and non-emitter materials, which can all act synergistically together to optimize emitter performance.

Figure 10A:
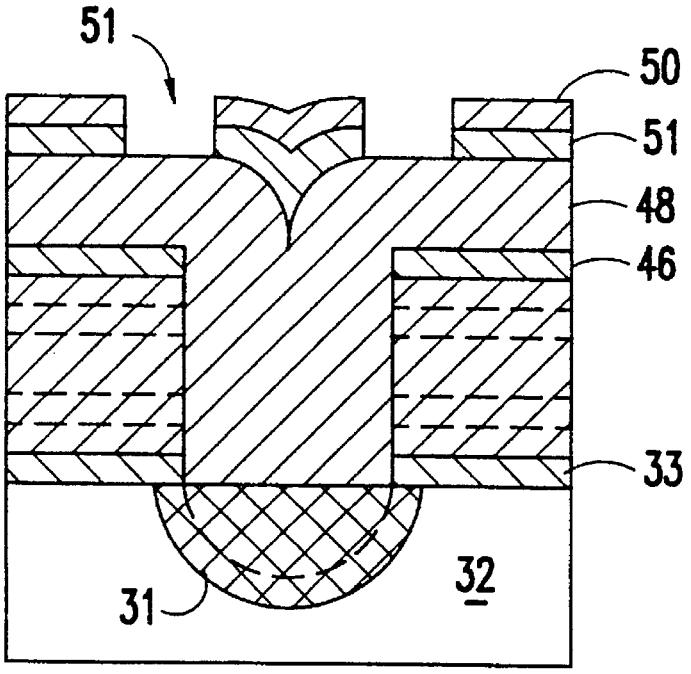
FIGS. 10A and 10B are cross-sectional views showing the process of etching the access holes and vacuum spaces.
Figure 10B:
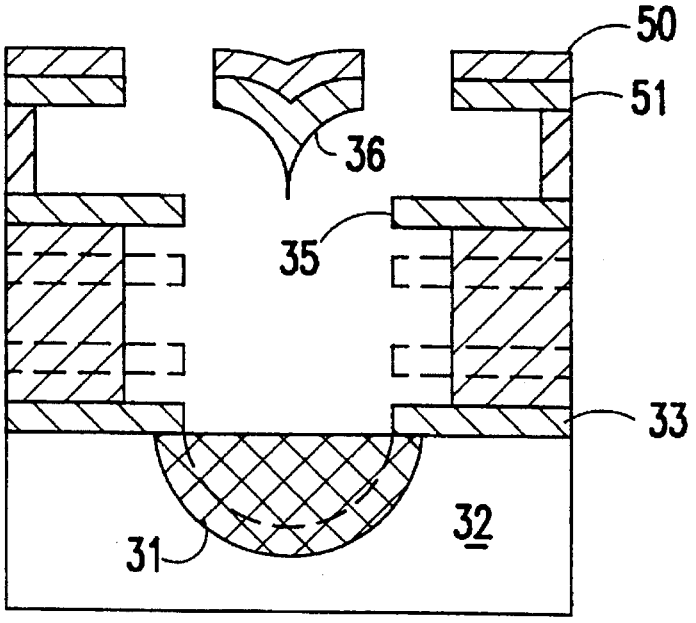

One or more access holes 51 are etched through the insulator layer 50 emitter layer 49 next to each emitter location in FIG. 10A. These holes allow a selective etchant to remove the conformal film 48 from the vacuum space hole. This is done using isotropic etching (e.g., wet or plasma), or combinations of anisotropic and isotropic methods to produce the structure shown in FIG. 10B. The conformal material 48 and the etchant used are chosen to minimize attack of the electrodes and phosphor layer. The referenced patent applications discuss these considerations in considerable detail and also discusses a two step etch technique for minimizing undercut.

The display structure itself is complete at this point in the process but requires a controlled environment for operation. Normally, the environment would be a vacuum maintained by an outer envelope which may be of any material that is sealable and hermetic. Getters are important in maintaining the operating environment over the lifetime of the display. Since the existing prototypes use both the front and back plate as part of the display structure, gettering materials must be added beyond the edge of the active area, increasing overall size.

Figure 11:
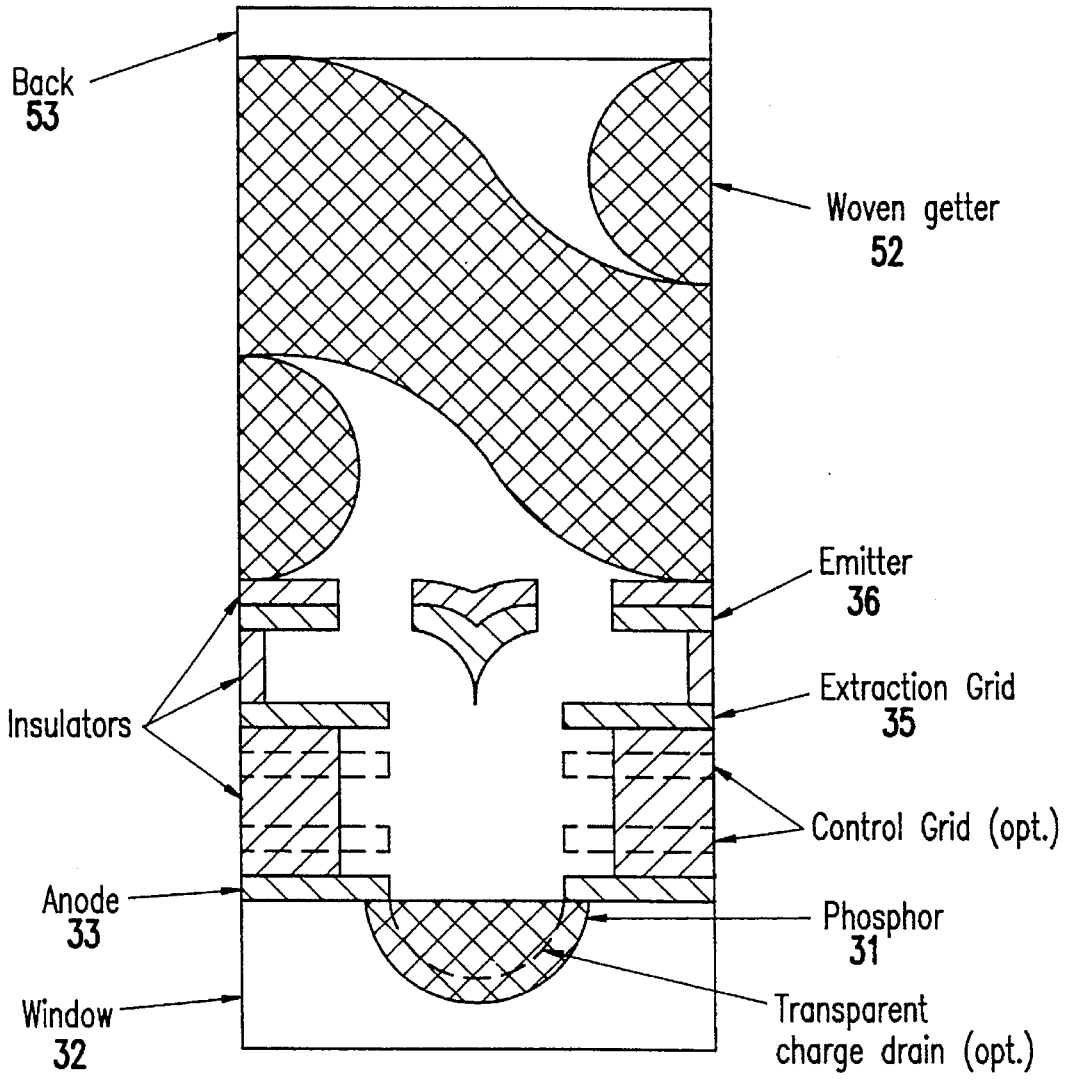
FIG. 11 is a cross-sectional view of showing the completed monolithic FED device structure.

In the preferred embodiment of the invention, a getter 52 in the form of a woven screen laid on the display structure as shown in FIG. 11, and in turn used to support a thin envelope 53. This screen 52 allows a large getter surface area, presents it in the vicinity of every access hole, and provides a manifold for the evacuation of the display. Alternatively, the display could be sealed in a vacuum environment. Sealing is done using any of the commonly applied techniques.

The monolithic display structure according to the invention has several advantages:

There are no elements on the envelope (back plate), as there are in existing prototypes, that need to be aligned with elements on the front; since the emitter spacing is not created by holding the window and back plate apart, the envelope may rest directly on the top of the display structure for support.

The envelope may be formed into a shape that provides a vacuum manifold without having to align support points to display structures.

Since the display structure can support the envelope, the envelope may be made of thin, light weight films of materials (e.g., glass, metal, ceramics, plastics, composites, etc.).

Gettering materials may be added between the display structure and the envelope offering a large effective area without increasing the extent of the display and providing a short path from the vacuum space to the getter through the access holes.

While the invention has been described in terms of a single preferred embodiment, those skilled in the art will recognize that the invention can be practiced-with modification within the spirit and scope of the appended claims.

Having thus described my invention, what I claim as new and desire to secure by Letters Patent is as follows:

1. A process of fabricating a monolithic field emission display (FED) device comprising the steps of:

depositing a phosphor layer on a face plate;

depositing an anode conductor over the phosphor layer on the face plate;

depositing one or more insulator layers over said anode layer to serve as a spacer;

depositing a grid conductor layer to serve as an extraction grid;

etching vacuum space holes extending through said grid conductor layer, said one or more insulator layers and said anode conductor to said phosphor layer;

depositing a conformal layer of a material that can be selectively etched, said conformal layer filling in and forming cusps over said vacuum space holes;

depositing an emitter conductor layer;

etching access holes through the emitter conductor layer; and then selectively etching said conformal layer to open said vacuum space holes.

2. The process recited in claim 1 further comprising the steps of:

forming rounded pockets in said one surface of said face plate over which said phosphor layer is deposited prior to the depositing of said phosphor layer; and polishing said phosphor layer to leave a flat surface with the pockets filed with said phosphor layer and said pockets being aligned with said vacuum space holes.

3. The process recited in claim 2 further comprising the step of etching said anode conductor to form a plurality of apertures aligned with said pockets in said one surface of the face plate.

4. The process recited in claim 2 further comprising the step of depositing a transparent conductive layer on said one surface of the face plate before said phosphor layer is deposited, said conductive layer serving to drain charge from said phosphor layer.

* * * * *